United States Patent [19]

McAvoy

[11] 3,980,095

[45] Sept. 14, 1976

[54] POWER TRANSMISSION

[76] Inventor: Dennis J. McAvoy, 3438 Bald Mountain Road, Lake Orion, Mich. 48035

[22] Filed: Feb. 10, 1975

[21] Appl. No.: 548,475

[52] U.S. Cl. ..... 137/117; 137/596.13

[51] Int. Cl.[2] ..... F15B 13/04

[58] Field of Search ..... 137/115, 117, 596.12, 137/596.13

[56] References Cited

UNITED STATES PATENTS

| | | | |
|---|---|---|---|
| 3,592,216 | 7/1971 | McMillen | 137/115 |
| 3,722,543 | 3/1973 | Tennis | 137/596.12 |

*Primary Examiner*—Alan Cohan
*Assistant Examiner*—Gerald A. Michalsky

[57] ABSTRACT

A combined unloading, relief, and load compensating valve has a poppet controlling flow between an inlet and an outlet and is spring biased to closed position. The poppet has a piston slidable in a cylindrical chamber in which the hydraulic pressure may be remotely controlled. The poppet is exposed over a small differential area to inlet pressure tending to open the poppet. The poppet and the piston are constructed as a cartridge which contains a second poppet valve and piston also controlling flow from the inlet to the outlet and is spring-biased to closed position, but openable by inlet pressure acting over a small area and the piston of the second poppet has approximately the same small area. Both pistons are connected to the common control passageway and the relative areas and spring bias forces are such that the first poppet acts as an unloading valve opening only when the control pressure is near zero and the second poppet acts as both a load compensator and a maximum pressure relief valve.

2 Claims, 1 Drawing Figure

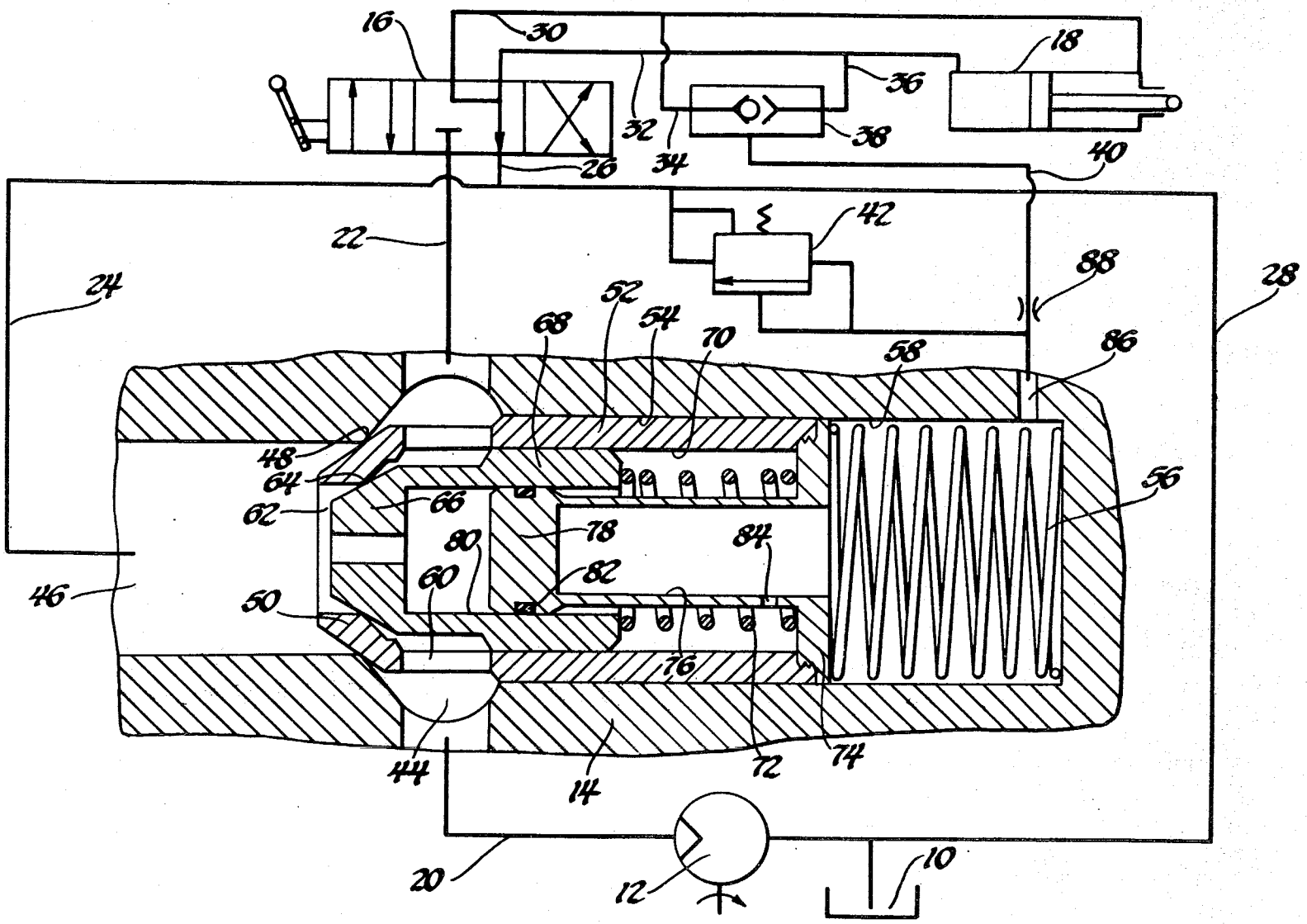
28
18
40
88
86
56
36
38
42
58
10
74
84
72
70
34
54
76
32
52
78
82
14
26
30
68
80
66
60
20
16
22
44
48
64
62
50
12
24
46

POWER TRANSMISSION

In hydraulic power transmissions systems, especially those using directional valves of the closed center type, an unloading valve is commonly used to direct pump delivery to a return passage at a low pressure drop when the directional valves are all in their centered positions. A relief valve is used in parallel with the unloading valve to limit the maximum system pressure, when fluid is being delivered to one or more hydraulic motors. It is also common to utilize a load compensating valve which senses the pressure at the motor and maintains a constant pressure drop across the directional valve. This latter valve is sometimes combined with the relief valve.

It is an object of the present invention to provide a unitary valve construction of the cartridge type which can be used to accomplish all three of the foregoing functions and thus simplify the construction and reduce the manufacturing cost of hydraulic power systems of the type described.

This object is achieved by the provision of a combined unloading, relief and load-compensating valve comprising a body having an inlet port and an exhaust port, a seat between the ports, and a cylinder chamber opposite the seat and having a diameter somewhat larger than the seat, a cartridge slidable in the chamber and having a poppet moveable to close the seat, a spring in the chamber urging the cartridge toward seat-closing position, a second inlet and a second outlet within the cartridge with a second seat between them, a second cylinder chamber opposite the second seat and having a diameter somewhat larger than the second seat, a second poppet slideable in the second chamber to close the second seat, a spring in the second chamber urging the poppet toward seat closing position, means attached to the second chamber for limiting the area of the second poppet exposed to pressure in the second chamber, a restricted passage connecting the first and second chambers, and a control passage leading from the first chamber, whereby when the control passage is connected to exhaust, the cartridge will shift to open the first seat, when the control passage is connected to a load sensing port the second poppet will maintain a fixed pressure difference between the first inlet port and the load sensing port, and when the control passage is connected to a pilot relief valve the second poppet will limit the maximum pressure at the first inlet port to a value determined by the setting of the pilot relief valve.

IN THE DRAWING:

The single FIGURE is a combined cross sectional view and circuit diagram of a valve and hydraulic power system incorporating a preferred form of the present invention.

The hydraulic power system illustrated comprises a reservoir 10 feeding a pump 12 of the fixed displacement type, a combined unloading, relief and load compensating valve 14, a directional valve 16 and a fluid motor 18. A delivery line 20 connects the pump to the valve 14 and an extension 22 thereof connects the valve 14 to the directional valve 16. Return or exhaust conduits 24, 26 and 28 serve to return fluid to the reservoir. Motor conduits 30 and 32 connect valve 16 to the motor 18 and have branches 34 and 36 leading to a shuttle valve 38 which feeds a conduit 40 through which the working pressure at the motor 18 may be sensed. A pilot relief valve 42 is connected between the conduit 40 and the return conduit 28 and is of preferably a manually adjustable type.

The valve 14 has an inlet port 44 and an outlet port 46, between which is a conical seat 48 adapted to be closed by a poppet valve 50. The poppet valve 50 has a piston portion 52 which is slidable in a cylindrical bore 54 and spring biased toward the seat 48 by a spring 56. The diameter of the piston 52 and the chamber 58 is somewhat larger than the area of seat 48 so that there is a small differential area over which pressure at the inlet port 44 may act to open the poppet against the force of the spring 56 whenever the pressure in chamber 58 is at a very low value.

The piston 52 is hollow and has an inlet port 60 and an outlet port 62 between which is a conical seat 64 closed by a poppet 66. The latter has a piston portion 68 slidable in a bore 70 and biased to closed position by a spring 72. The right end of bore 70 is closed by a cap 74, having a thin-walled tubular extension 76, which carries at its left end a spud 78. A bore 80 within the piston 68 is slidable on the spud 78 and its sealing ring 82. An orifice 84 connects the chamber 58 with the chamber 70. The chamber 58 has a control port 86 to which the load sensing conduit 40 is connected. A restrictor 88 is located in the load sensing line 40 at a point between the shuttle valve 38 and the pilot relief valve 42.

The parts are illustrated in the position they would occupy when the pump 12 is not running. When the pump is started with the directional valve 16 in its closed center position as illustrated pressure will immediately build up in the inlet port 44 and since the control port 86 is connected to the reservoir through sensing line 40 shuttle valve 38 and one or the other of the motor lines 32, the inlet pressure acting on the differential area of the poppet 50 between seat 48 and bore 54 will shift the poppet to the right against the light force of spring 56 and exhaust all of the pump delivery back to the pump reservoir through lines 24 and 28. In this way, the cartridge 50, 52 acts as an unloading valve.

When the directional valve 16 is shifted to one or the other of its motor operating positions, say to the right, pump delivery is directed from conduit 22 to conduit 30 and as resistance to movement of the motor 18 is experienced, the pressure in that line will build up shifting the shuttle valve 38 to the right and delivering motor pressure to the load sensing conduit 40 and chamber 56. If the spring 58 has not already done so, this will shift the cartridge 50, 52 back to the left closing the seat 48 and directing all of the pump delivery into conduit 22 and thence to the motor 18. If the valve 16 is shifted to the right a distance somewhat less than its full travel, a throttling effect will take place in the valve 16 restricting the rate of flow into conduit 30. Under these conditions, the motor operating pressure is sensed in the chamber 70 by way of the conduits 30, 34, 40, 86, 58 and orifice 84. This causes the poppet 66 and piston 68 to act as a compensating valve discharging over the seat 64 whatever quantity of pump delivery fluid is not required in order to maintain a constant pressure drop across the throttling orifice in the valve 16. Thus, the poppet 66 acts as a load compensating valve. If at any time when the valve 16 is shifted, either partly open or wide open, the load on the motor 18 should become excessive the pilot relief valve will sense the resulting pressure rise and open causing a flow through the sensing line 40 and the restrictor 88 back to the reservoir. This will allow the pressure in the chamber 70 to fall below the inlet pressure in port 60 which can then shift the poppet 66 to the right dumping all of the pump delivery to the reservoir through the seat 64.

It will be noted that the bore 70 is concentric with the outer diameter of the piston 52 and that that bore 80 is concentric with the outer diameter of the piston 68. Since it is not possible by ordinary commercial methods of manufacture to maintain such concentricities to absolute perfection, the construction of the spud 78 with its thin walled tubular portion (shown on the drawing) allows for reasonable tolerances in manufacture of the pistons 68 and 52 while at the same time allowing a reasonably close fit between spud 78 and bore 80.

I claim:

1. A combined unloading, relief and load compensating valve comprising a body having an inlet port and an outlet port, a seat between the ports, and a cylinder chamber opposite the seat with a diameter somewhat larger than the seat, a cartridge slidable in the chamber and having a poppet movable to close the seat, a spring in the chamber urging the cartridge toward seat-closing position, a second inlet and a second outlet within the cartridge with a second seat between them, a second cylinder chamber opposite the second seat and having a diameter somewhat larger than the second seat, a second poppet slidable in the second chamber to close the second seat, a spring in the second chamber urging the poppet toward seat-closing position, means attached to the second chamber for limiting the area of the second poppet exposed to pressure in the second chamber, a restricted passage connecting the first and second chambers, and a control passage leading from the first chamber whereby when the control passage is connected to exhaust, the cartridge will shift to open the first seat, when the control passage is connected to a load sensing port the second poppet will maintain a fixed pressure difference between the first inlet port and the load sensing port, and when the control passage is connected to a pilot relief valve, the second poppet will limit the maximum pressure at the first inlet port to a value determined by the setting of the pilot relief valve; the area limiting means comprising a bore within the second poppet valve and a spud fixed to the cartridge and on which the bore is slidably positioned.

2. A valve as defined in claim 1 wherein the bore in the poppet is substantially concentric with the second cylindrical chamber and the spud is supported on a relatively thin tubular stem to allow slight lateral movement of the spud caused by any slight departure from true concentricity arising in manufacture.

* * * * *

UNITED STATES PATENT AND TRADEMARK OFFICE

CERTIFICATE OF CORRECTION

PATENT NO. : 3,980,095

DATED : September 14, 1976

INVENTOR(S) : Dennis J. McAvoy

It is certified that error appears in the above-identified patent and that said Letters Patent are hereby corrected as shown below:

In the patent heading, a line should be inserted reading --Assignee: Sperry Rand Corporation, Troy, Michigan Signed and Sealed this Thirtieth Day of November 1976

[SEAL]

*Attest:*

RUTH C. MASON
*Attesting Officer*

C. MARSHALL DANN
*Commissioner of Patents and Trademarks*